US005904171A

United States Patent [19]

Stahle et al.

[11] Patent Number: 5,904,171

[45] Date of Patent: May 18, 1999

[54] RELIEF VALVE

[75] Inventors: Manfred Stahle; Dieter H. F. Kallenbach, both of Sandton, South Africa

[73] Assignee: Corrupipe CC, South Africa

[21] Appl. No.: 08/865,146

[22] Filed: May 29, 1997

[30] Foreign Application Priority Data

Jul. 25, 1996 [ZA] South Africa ..... 96/6316

[51] Int. Cl.[6] ..... G05D 11/03

[52] U.S. Cl. ..... 137/114; 137/907

[58] Field of Search ..... 137/114, 907; 15/1.7

[56] References Cited

U.S. PATENT DOCUMENTS 4,368,751 1/1983 Chauvier ..... 137/114 X 5,285,547 2/1994 Sebor ..... 15/1.7

5,337,433 8/1994 Gould et al. ..... 15/1.7

5,570,713 11/1996 Stoltz et al. ..... 137/114 X

FOREIGN PATENT DOCUMENTS 2182551 5/1987 United Kingdom ..... 15/1.7

*Primary Examiner*—Stephen M. Hepperle

*Attorney, Agent, or Firm*—Banner & Witcoff, Ltd.

[57] ABSTRACT

A relief valve for use with automatic suction operated swimming pool cleaners which has a tubular body and a bypass passage into the body inclined at an acute angle to the inlet and controlled by a closure pivotally supported about an end upstream of the normal flow direction through the valve and with the closure biased, preferably by at least one tension spring, to the closed position.

11 Claims, 1 Drawing Sheet

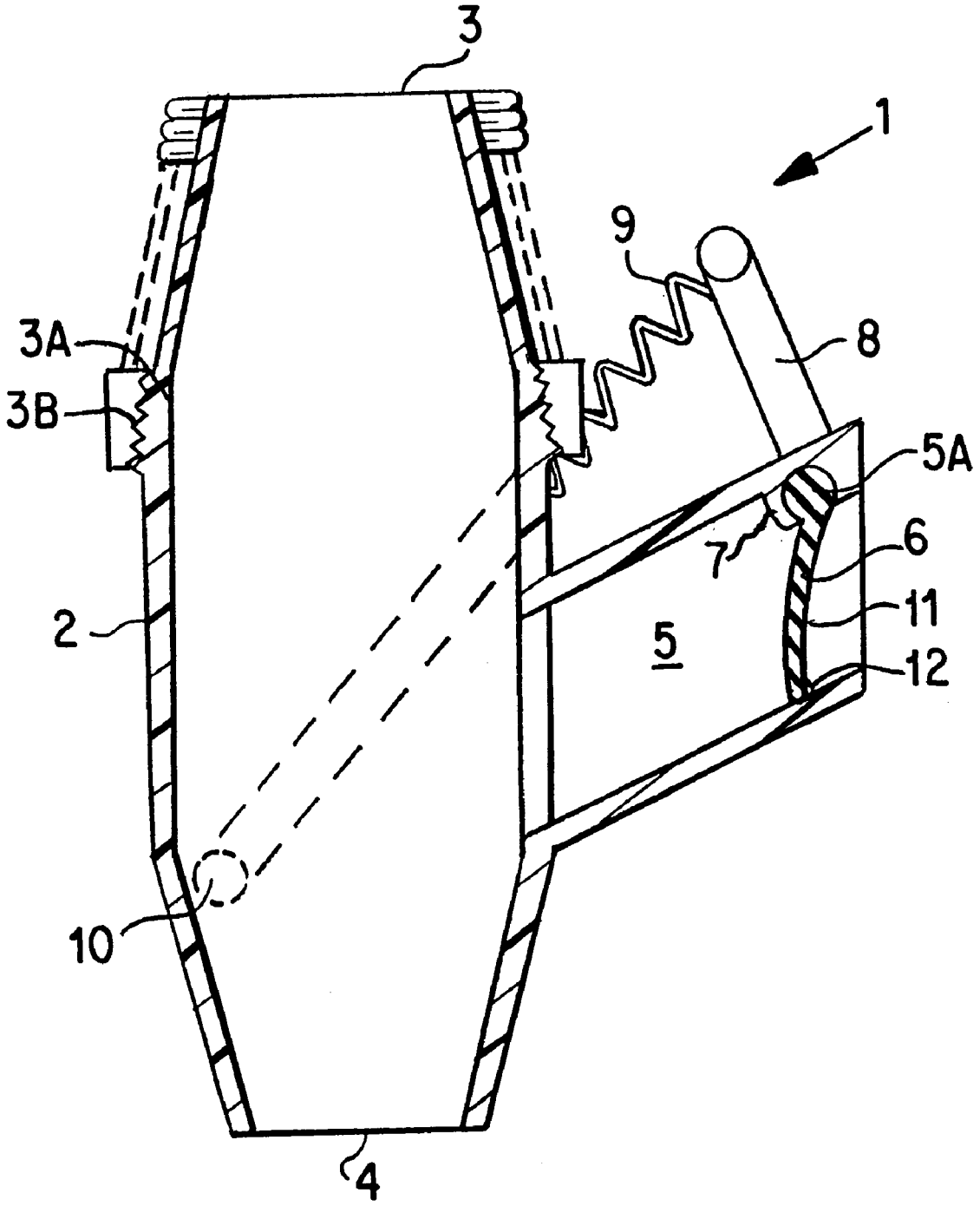
3
1
9
8
3A
3B
5A
7
6
11
2
5
12
10
4

RELIEF VALVE

FIELD OF THE INVENTION

This invention relates to a relief valve and more particularly but not exclusively to a relief valve used to control the flow through a suction operated automatic swimming pool cleaner.

BACKGROUND OF THE INVENTION

The optimum operation of a suction operated automatic swimming pool cleaner is usually very much dependant on the rate of flow of water through the cleaner. Too much flow tends to make the cleaner adhere too tightly to the surface being cleaned and too little flow prevents propulsion of the cleaner.

Several kinds of valve have been developed for this specific use and do operate with a greater or lesser degree of success. Some tend to choke on debris in the pool water, others are relatively complicated constructions and some by nature of their location in the pool filtration system induce vortex flow and the admission of air into the filtration system.

OBJECT OF THE INVENTION

It is the object of the present invention to provide a valve which will largely mitigate the above disadvantages.

SUMMARY OF THE INVENTION

According to this invention there is provided a relief valve comprising a tubular body having an inlet and an outlet, a by-pass through a connection passage inclined at an acute angle to the body with respect to the inlet, a closure for the by-pass pivotally supported in the by-pass to open in an upstream direction of normal flow through the body and biasing means to hold the closure in the closed position.

Further features of this invention provide for the face of the closure facing out of the by-pass passage to be dished, for the biasing to be adjustable and for the biasing to be effected by means of at least one tension spring anchored to the body at one end and to an extension to the opposite side of the pivot support from the by-pass closure at the other.

The invention also provides for the tension spring or springs to be positioned from the extension to an anchor or anchors located on the body on the opposite side of the pivot support for the closure to the extension.

BRIEF DESCRIPTION OF THE DRAWINGS

These and other features of this invention will become apparent from the following description of a preferred embodiment in which reference is made to the accompanying drawing illustrating a longitudinal cross section through the relief valve.

DETAILED DESCRIPTION WITH REFERENCE TO THE DRAWINGS

As shown, the relief valve (1) is suitable for use in a domestic swimming pool filtration system incorporating a suction operated swimming pool cleaner.

The valve (1) has a tubular body (2) with a tapered inlet (3) and outlet (4) suitable for frictional engagement in the usual pool weir outlet and the end of a flexible suction hose.

To enable the connection to the inlet (3) to be effected with a female cuff on the end of a length of hose, as opposed to the end of the hose being attached by insertion onto the inlet directly, a shoulder **(3*a*) is provided on the body (2). The outer surface of this shoulder carries a series of peripheral serrations (3*b*)** as shown. The fitting of a cuffed hose end is indicated in dotted lines in the drawing.

The body (2) has a by-pass inlet opening through a short tubular passage (5) which is inclined to the inlet and of the body (2) at an acute angle of between 5° and 50°. The angle is preferably made to be about 30°. The passage is generally U-shaped in cross-section.

A closure (6) is pivotally mounted across the ends of the arms of the U-shape at the free end of the tubular passage (5) with the pivot axis at right angles to the axis of the body (2) so that the closure can swing into the passage (5) with its free end moving arcuately in a direction towards the inlet end of the body (2).

Suitable mountings (7) for the pivot are provided on the end of the passage (5). These can conveniently be slots shaped to receive pintles **(5*a*) extending from the end of the closure (6)**.

A pair of arms (8) forming extensions to the closure (6) project outwardly one from each pintle **(5*a*) on each side of the body (2). Tension springs (9)** are attached to these extensions. While not usually necessary for domestic swimming pool installations, the point of attachment along the length may be varied to suit particular requirements.

The other ends of the springs (9) are anchored to projections (10) on the body (2) so that the closure (6) is biased by the springs to the closed position. The projections (10) extend from the opposite side of the body to the passage (5) and are located on the body at positions which in use are downstream of the arms (8).

This arrangement results in the leverage applied by the tension in the springs decreasing as the arms rotate about the pivot and the spring tension increases. The maximum opening of the closure (6) by contact with the inner wall of the passage (5) is made to ensure that the spring wilt always act to move the closure (6) to close the passage (5).

The arrangement of the springs in this manner is important because it enables the effect of the springs to be varied and controlled during opening of the passage (5). This is desirable because the greater the requirement for by-pass flow through the valve, the less is the effect of ambient pressure on the closure.

Thus the effect of the springs is made to be less during the final stages of opening of the valve than during the initial stages.

It is a feature of this invention that the surface (11) of the closure (6) which face outwardly from the passage (5) is dished to provide a lip (12) at its free end as this has also been found to assist in the full opening of the valve.

In use, if the flow induced through the pool cleaner exceeds a predetermined rate usually in the order of 72 liters per minute through a 12 meter length of flexible hose, the pressure in the body will reduce below the external ambient pressure by an amount which will enable this ambient pressure to exert a force on the closure (6) sufficient to cause the closure (6) to open and allow a relief flow through the by-pass passage (5).

It will be appreciated that the degree of opening will be dependent on the differential pressure across the closure (6) and the opening will be to a greater or lesser degree depending on this differential. It has further been found that the dishing of the closure face (11) materially assists in the smooth and efficient operation of the valve in that the flows of water through the body and the bypass passage (5) over the closure into the outlet of the body merge smoothly.

A further material effect is obtained through the inclination of the bypass to the body in that this has been found to enable debris encountered in normal swimming pool installation and entrained in the relief flow to pass easily through the valve.

It will be appreciated that the construction of the valve is simple in that it involves only two mouldings of suitable plastics material and a pair of tension springs. These components can readily be assembled by unskilled labour.

The invention thus provides a relief valve which is simple to construct, inexpensive to manufacture and which operates effectively.

What I/we claim as new and desire to secure by letters patent is:

1. A relief valve comprising a tubular body having an inlet and an outlet, a by-pass trough a connection passage inclined at an acute angle of between 5° and 50° to the body with respect to the inlet, the passage being of U-shape in cross-section, a closure for the by-pass pivotally supported therein between the ends of the arms of the U-shape to open in an upstream direction of normal flow through the body and biasing means to hold the closure in the closed position in the form of at least one tension spring anchored to the body at one end and to an extension to the opposite side of the pivot support from the by-pass closure at the other.

2. A relief valve as claimed in claim 1 in which the anchor point for said at least one spring is located on the body on the opposite side of the pivot support to the extension.

3. A relief valve as claimed in claim 1 in which said at least one tension spring includes a tension spring on each side of the body and the extension is provided by a pair of lever arms, one on each side of the closure.

4. A relief valve as claimed in claim 1 in which the surface of the closure facing out of the by-pass passage is dished towards its free end to provide a peripheral lip around said end of the closure.

5. A relief valve as claimed in claim 1 in which a collar is provided around the inlet of the body to receive a female cuffed end of a flexible hose.

6. A relief valve comprising a tubular body having an inlet and an outlet, a by-pass through a connection passage inclined at an acute angle of between 5° and 50° to the body with respect to the inlet, said connection passage being of U-shape in cross-section, a closure for the by-pass pivotally supported therein between the ends of the arms of the U-shape to open in an upstream direction of normal flow through the body and biasing means to hold the closure in the closed position.

7. A relief valve as claimed in claim 6 in which said biasing means includes at least one tensions spring anchored at a first end to said tubular body and at a second end to an extension of the pivot support, said extension being spaced from the by-pass closure.

8. A relief valve as claimed in claim 7 in which said at least one spring is anchored to the body on an opposite side of the pivot support from said extension.

9. A relief valve as claimed in claim 6 in which said biasing means includes two tension springs, each said spring attached at a first end to one side of the body and at a second end to an extension of a respective one of a pair of lever arms, one arm of said pair of lever arms being on each side of the closure.

10. A relief valve as claimed in claim 6 in which the surface of the closure facing out of the by-pass connection passage is dished towards its free end to provide a peripheral lip around said end of the closure.

11. A relief valve as claimed in claim 6 in which a collar is provided around the inlet of the body to receive a female cuffed end of a flexible hose.

* * * * *